US005746662A

United States Patent [19]

Squire

[11] Patent Number: 5,746,662

[45] Date of Patent: May 5, 1998

[54] CONTROLLED PENDULUM GOLF PUTTER

[76] Inventor: Herbert D. Squire, 67 River Isles, Bradenton, Fla. 34208

[21] Appl. No.: 851,676

[22] Filed: May 6, 1997

[51] Int. Cl.[6] ..... A63B 69/36

[52] U.S. Cl. ..... 473/206; 473/231; 473/295

[58] Field of Search ..... 473/201, 206, 473/223, 226, 231, 257, 295, 293, 238, 251

[56] References Cited

U.S. PATENT DOCUMENTS

| | | | |
|---|---|---|---|
| D. 104,642 | 5/1937 | Sylvester . | |
| D. 349,546 | 8/1994 | MacDougall . | |
| D. 369,394 | 4/1996 | North . | |
| 760,161 | 5/1904 | Smith . | |
| 1,616,377 | 2/1927 | Knight . | |
| 2,445,718 | 7/1948 | Sternberg . | |
| 3,182,401 | 5/1965 | Stevens . | |
| 3,198,525 | 8/1965 | Smith . | |
| 3,430,963 | 3/1969 | Wozniak et al. . | |
| 3,459,426 | 8/1969 | Sherwood . | |
| 3,462,155 | 8/1969 | Pelz . | |
| 3,495,834 | 2/1970 | Tanczos . | |
| 3,533,630 | 10/1970 | Monaco | 473/206 |
| 3,663,019 | 5/1972 | Palotsee . | |
| 3,679,207 | 7/1972 | Florian . | |
| 4,174,838 | 11/1979 | Paschetto . | |
| 4,211,415 | 7/1980 | Lindo . | |
| 4,227,694 | 10/1980 | Drake . | |
| 4,252,317 | 2/1981 | Vezina . | |
| 4,789,158 | 12/1988 | Chiesa . | |
| 4,884,813 | 12/1989 | Cates . | |
| 5,125,657 | 6/1992 | Beil . | |
| 5,127,650 | 7/1992 | Schneller . | |
| 5,152,533 | 10/1992 | Radakovich . | |
| 5,188,361 | 2/1993 | Coombe . | |
| 5,308,071 | 5/1994 | Lewis . | |
| 5,401,022 | 3/1995 | McCready . | |
| 5,474,300 | 12/1995 | Scalise et al. . | |
| 5,595,385 | 1/1997 | Jablonski | 473/295 |

*Primary Examiner*—Sebastiano Passaniti
*Attorney, Agent, or Firm*—Jones & Askew, LLP

[57] ABSTRACT

An improved pendulum-type golf putter is disclosed. The putter includes a club head and an elongate main shaft extending upwardly from the club head. A bearing head is affixed on the end of the main shaft opposite the club head and has a bore with an axis extending substantially parallel to the club head. An elongate substantially horizontal second shaft is rotatably mounted in and extends through the bore of the bearing head. A first forward handle is affixed to one end of the second shaft for gripping by a user to support the club for pendulum-like action. A second handle is affixed to the opposite end of the second shaft and extending rearwardly toward the user. A user grips the first handle in order to support the putter, rests the second handle against the body, and rotates the main shaft about the axis of the bearing head so as to swing the club head in a pendulum-like arc. Also disclosed is a removable sight affixed to the end of the first forward handle, extending perpendicularly to the first handle, for sighting down to the golf ball and out to the putting target.

18 Claims, 2 Drawing Sheets

CONTROLLED PENDULUM GOLF PUTTER

TECHNICAL FIELD

The present invention relates generally to golf putters, and relates more specifically to an improved pendulum-type golf putter that allows more control over the pendulum action during the swinging operation.

BACKGROUND OF THE INVENTION

There is an old adage about golf-"drive for show, putt for dough." Many golfers believe that putting is the heart of the golf game. Some golfers practice the putt for years but are still not satisfied with their putting ability or with their putters. Golfers have long searched for better putters and better putting techniques in order to improve their putting games.

Many golfers believe that swinging the golf putter with a pendulum action provides a motion that leads to consistency and accuracy in putting. It is believed that if the ball is struck squarely with the putter head, it will follow a line defined by the path that the putter has taken during the backswing and follow through. Accordingly, modifications have been made to golf putters to improve or enhance a pendulum-like motion, and to encourage the backswing and follow-through be in perfect alignment with the hole. U.S. Pat. No. 5,127,650 to Schneller and U.S. Pat. No. 5,125,657 to Beil describe pendulum-type golf putters.

U.S. Pat. No. 5,474,300 to Scalise et al. describes a putter for use in training a golfer in a style of putting in which a crossrod at the upper end of the club shaft is provided with a sleeve supported at each end by ball bearings. The crossrod is mounted to the club shaft at a right angle, but the putter head is affixed to the shaft at an angle.

However, putters constructed in accordance with this patent have certain shortcomings. With a Scalise putter, a golfer maintains a firm grip on the sleeve with one hand during the backswing and attempts a pendulum-like stroke by using the other hand to grip and twist a portion of the crossrod that extends out away from the golfer in order raise the club head to a desired height during the backswing. This putter forces the user to twist the crossbar in order to raise the shaft of the putter, causing undesirable torque on the wrist. Furthermore, a player must hold the handle at a slight incline to keep the club head swinging on a level plane, which makes a consistent pendulum action more difficult.

U.S. Pat. No. 4,252,317 to Vezina describes a putter comprised of a lower shaft and an upper shaft, both shafts being rotatable with respect to one another. The putter has a bilaterally symmetrical head which enables conversion of a right handed putter into a left handed putter and vice versa. The handle is arranged so as to create a pendulum effect thus enabling the putter head to hit the ball and causing it to travel along a very straight line. As in the Scalise et at. patent, the handle extends at a right angle with respect to the shaft.

However, in a Vezina putter the head is affixed at a right angle to the shaft and the horizontal handle extends toward the golfers body, which forces the golfer to hold the handle very close to the body and stand very close to the ball, almost over the ball. This can interfere with the arc of the swing or cause the club or ball to hit the golfer's foot.

Despite such efforts to provide or improve a pendulum like motion for golf putting, there is still a need for a pendulum putter which ensures that the club head will travel on a straight vertical plane.

SUMMARY OF THE INVENTION

The present invention provides an improved golf putter that facilitates a pendulum-like arc for the putter head.

Briefly described, the invention is a golf putter with a club head, an elongate shaft affixed to and extending upwardly from the club head at a predetermined angle, a horizontal first forward handle rotatably affixed to the upper end of the shaft at a second predetermined angle and extending away from a user for gripping by the user, a horizontal second handle rotatably affixed to the upper end of the shaft and extending toward the user, and a third handle affixed to the end of the shaft opposite the club head.

To use the putter, a user grips the first handle in order to support the putter, rests the second handle against the body, and employs the third handle to rotate the shaft relative to the axis of the first handle so as to swing the club head in a pendulum-like arc. Advantageously, the angle(s) of the shaft relative to the club head and to the first and second horizontal handles position the club head away from the golfer's body a slight distance, and encourage the club head to swing in a perfect arc. Because the first and second handles are held firmly in place during the backswing and release, the face of the club head is steady and is less likely to turn during the pendulum motion. As a result of the steadiness, the ball is more likely to travel in a straight path.

Preferably, the first handle is relatively longer than said second handle so that the golfer can comfortably grip the first handle while resting the second handle against the abdomen or belt buckle. Moreover, the club head preferably is bilaterally symmetrical so that the putter can be used by both left-handed and right-handed golfers.

It will be appreciated that because of the structure of the putter, the long shaft of the putter pivots at a point between the first handle and the second handle where a bearing head is located. The positioning of the pivot between the first handle and second handle ensures that the long shaft will pivot on a horizontal axis. The club head swings relative to an imaginary horizontal axis extending outwardly from the first handle, in a vertical plane that extends downwardly to the sweet spot of the club head. Thus, the club head is caused to swing in a near perfect vertical plane even though the shaft of the putter is held near the body of the golfer.

More particularly described, the present invention comprises a club head, an elongate first shaft extending upwardly from the club head, and a bearing head affixed on the end of the first shaft opposite the club head and having a bore with an axis extending substantially parallel to the club head. An elongate substantially horizontal second shaft is rotatably mounted in and extending through the bore of the bearing head. The horizontal first forward handle is affixed to one end of the second shaft and extends in the direction of the club head for gripping by a user. A second handle is affixed to the opposite end of the second shaft and extends rearwardly toward the user. A third handle is affixed to the end of the first shaft opposite the club head and is employed to swing the putter in the usual manner.

Preferably, the first shaft is affixed to the bearing head at an acute angle so that the shaft extends downwardly and away from the user, to position the club head a short distance out from the golfer's feet for a comfortable stance.

Still more particularly described, the first handle preferably comprises an aluminum cylinder press fitted onto the second shaft and an outer grip affixed to the aluminum cylinder. Further, the second handle preferably comprises an aluminum cylinder press fitted onto the second shaft and an outer grip affixed to the aluminum cylinder. Moreover, the first handle is preferably relatively longer than the second handle.

According to another aspect of the invention, there is provided an improved pendulum-type golf putter with an alignment sight to facilitate swinging the club and aligning the putt. A putter constructed in accordance with this aspect of the invention comprises a club head, an elongate shaft extending upwardly from the club head, a rotatable handle affixed to the end of the shaft opposite the club head, and an elongate linear alignment sight affixed to and extending perpendicularly from the end of the rotatable handle for allowing the user to align the club head in the desired direction of putting.

To use the putter with alignment sight, a user swings the shaft relative to the rotatable handle to move the club head in a pendulum-like arc and sights along the alignment sight to align the putt. Preferably, the rotatable handle is affixed to the shaft at a predetermined angle such that the shaft extends downwardly from the rotatable handle and away from the user, allowing the user to sight the putt looking down over the alignment sight at the club head.

Accordingly, it is an object of the present invention to provide an improved pendulum-type putter.

It is another object of the present invention to provide an improved putter that swings in a near perfect vertical plane.

It is another object of the invention to provide an alignment sight for a pendulum-type putter.

These and other objects, features, and advantages of the present invention will become apparent upon reading the following specification, when taken in conjunction with the drawings and the appended claims.

DETAILED DESCRIPTION OF THE PREFERRED EMBODIMENTS

Figures 1, 2, 3, 4:
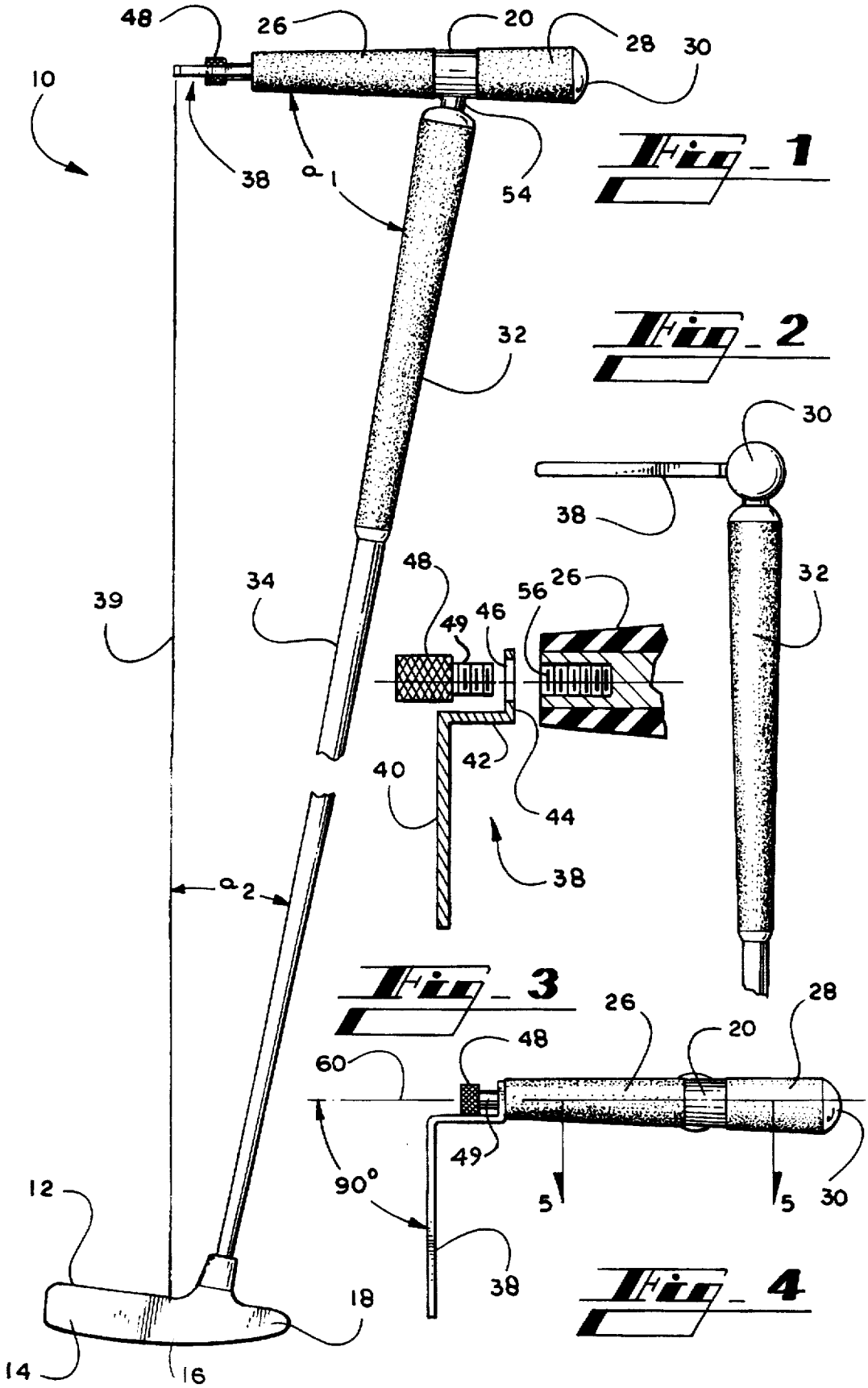
FIG. 1 illustrates a pendulum putter constructed in accordance with the preferred embodiment of the present invention.
FIG. 2 is a rear view of the pendulum putter of FIG. 1.
FIG. 3 is an exploded view showing the structure of the alignment sight and attachment to the handles.
FIG. 4 is a top view of the pendulum putter of FIG. 1.

Referring now to the drawings, in which like numerals indicate like elements throughout the several views, FIG. 1 illustrates a pendulum putter 10 constructed in accordance with the preferred embodiment of the present invention. The putter 10 has a club head 12 having a ball striking face or "sweet spot" 16 between the toe 14 and heel 18 thereof. The club head 12 is preferably bilaterally symmetrical so that the putter can be used by either a right handed or left handed golfer.

A pendulum by definition swings in a straight vertical plane. This requires that the pendulum must have an axis that is maintained horizontal.

An elongate first or main putter shaft 34 extends upwardly from the club head 12. A rotatable first forward handle 26 extends in the direction of the club head 12 for gripping by a user and a second handle 28 extends rearwardly toward the user. Both the first handle 26 and the second handle 28 are generally cylindrical and taper slightly so that the portion of the second handle towards the user has a circumference greater than the end of the first handle extending away from the user. A rounded handle butt end 30 is affixed to the end of the second handle 28. In use, the butt end 30 is rested against the abdomen or belt of the golfer. Preferably, the first handle is of a length that can be gripped by the full palm of the golfer's hand.

A bearing head 20 is affixed to the end of the main putter shaft 34 opposite the club head 12, and allows for rotation of the main shaft relative to the handles 26, 28. Preferably, the main putter shaft 34 is affixed to the bearing head 20 at a predetermined angle $a_1$, approximately 5–10 degrees, so that the shaft 34 extends downwardly and away from the golfer to position the putter head 12 a slight distance away from the golfer.

As also seen in FIG. 1, the main putter shaft preferably extends upwardly from the club head at a slight predetermined angle $a_2$., which is preferably the same angle as $a_1$. This compensates for the attachment of the main shaft 34 at the angle $a_1$ to the bearing head 20 and keeps the club head parallel to the ground when the club is swung. Advantageously, the structure provides that the club head 12 swings in a vertical plane defined by an imaginary line, e.g. line 39, extending vertically upward from the club head that intersects with the axis of the handles 26, 28.

A third handle or grip 32 is affixed to the end of the first shaft 34 opposite the club head 12 but below the bearing head 20. The third handle 32 preferably provides a conventional putter grip.

A removable elongate linear sight 38 is attached at the end of the first handle 26 extending away from the golfer's body. As described below, the sight 38 allows the golfer to align the putt with the hole, for example by sighting downwardly along a line such as 39 to the club head and golf ball, and along the sight toward the cup.

Referring now to FIG. 2 in conjunction with FIG. 1, the linear sight bar 38 is attached to and extends perpendicularly from the end of the first handle 26 and preferably extends over the sweet spot 16 of the club head 12. This allows the user to align the club head 12 in the desired direction of putting. The sight bar aligns with the ball and shows the path that the ball will follow. Because the upper handles and the sight bar remain stationary during the putt, such a construction provides for better sighting than devices that move with the club.

As shown in FIG. 3, the sight 38 is generally "z" or dogleg shaped having a first elongate leg 40, a substantially shorter second leg 42 extending perpendicular from the first leg, and a third leg 44 extending perpendicular from the second leg in the same direction as the first leg. The third leg 44 includes an opening 46 for receiving a threaded shaft 49 of a knurled knob 48 that affixes the sight to the first handle 26.

As seen in FIG. 4, the threaded shaft 49 of the knurled knob 48 extends through the hole 46 in the third leg 44 of the sight 38 and is received within a threaded opening 56 defined in the first handle 26, to fasten the sight to the first handle. When so affixed, the alignment sight 38 rotates with the handles 26, 28 so the golfer can bring the sight into a substantially horizontal position for aiming and sighting the putt. If desired, the sight 38 can be removed from the putter by unscrewing the knob 48 and slipping the sight off the threaded knurled knob.

Figure 5:
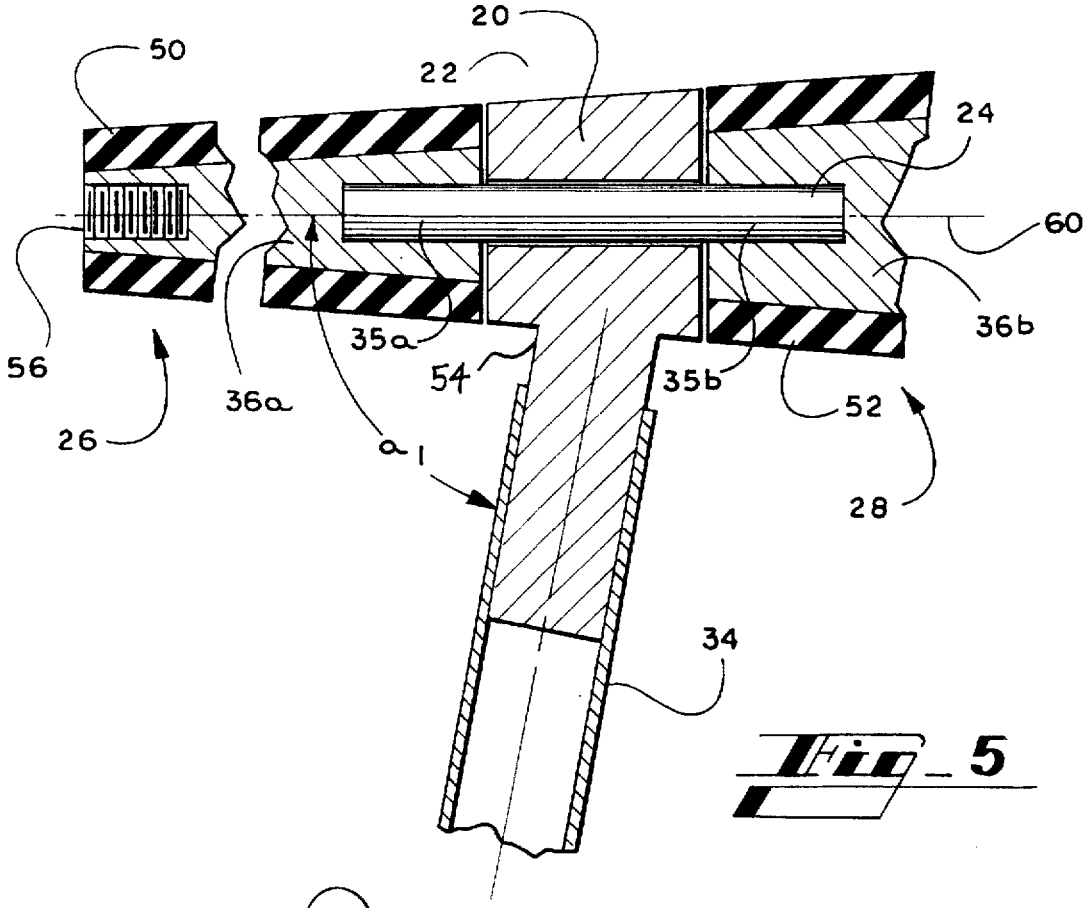
FIG. 5 is a partial cross-sectional view of the first handle, bearing head and second handle of the pendulum putter of FIG. 1, taken along the line 5—5 of FIG. 4.

Referring now to FIG. 5, the bearing head 20 is preferably constructed of a die cast metal such as zinc, brass or aluminum, and has a bore 22 with an axis 60 extending substantially parallel to the club head 12. An elongate substantially horizontal second shaft or rod 24 is rotatably mounted in and extends through the bore 22 of the bearing head 20, with ends 35*a*, 35*b* that extend beyond the bearing head 20 a predetermined distance. The end 35*a* of the rod 24 extending away from the user is press fit into an aluminum cylinder 36*a* that forms a part of the first handle 26. The other end 35*b* of the rod extending toward the golfer is press fit into a second aluminum cylinder 36*b* which forms a part of the second handle 28. The aluminum cylinders 36*a*, 36*b* each have a grip, 50 and 52 respectively, fitted to the cylinders thereby forming the first handle 26 and the second handle 28 of the putter. Preferably, the cylinders 36*a*, 36*b* are slightly tapered, with the larger diameter on the cylinder 36*b* of the second handle 28, tapering down to a smaller diameter of the cylinder 36*a* of the first handle 26, to provide a pleasing shape and grip.

Still referring to FIG. 5, a fourth shaft or rod 54 is integral with the bearing head and extends down into the main shaft 34. The rod 54 is preferably formed integral with the bearing head 20 by die casting, and extends at a predetermined angle $a_1$, approximately 5–10 degrees, so that the main putter shaft 34 extends downwardly and away from the golfer to position the head on the turf a short distance out from the golfer's body. The exact angle will be determined primarily as a function of the length of the main shaft 34 and the angle at which the head is affixed to the main shaft.

Advantageously, it is possible to convert a conventional golf putter into a pendulum putter in accordance with the present invention by affixing a bearing head 20 as an extension of the main putter shaft 34. This extension would consist of a subassembly of the bearing head, the first handle 26, and second handle 28.

It will also be noted in FIG. 5 that the aluminum cylinder 36*a* is drilled and tapped to define the threaded opening 56 for attachment of the alignment sight. Other methods of attachment of the alignment sight may occur to those skilled in the art and are considered equivalent.

Figure 7:
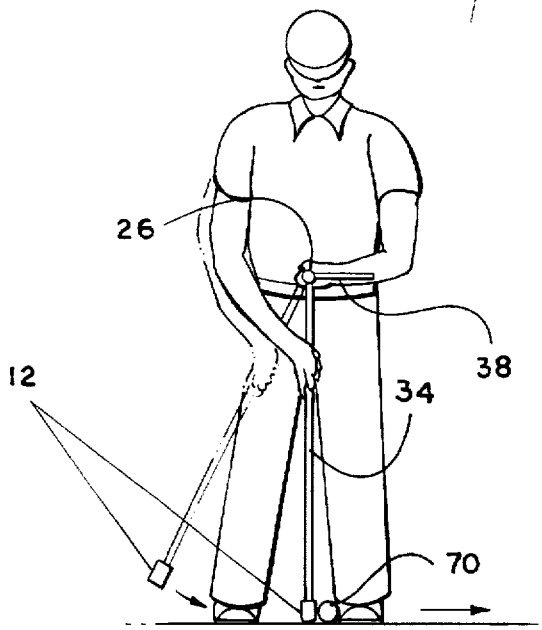
FIGS. 6 and 7 illustrate a golfer using a putter constructed in accordance with the invention.
Figure 6:
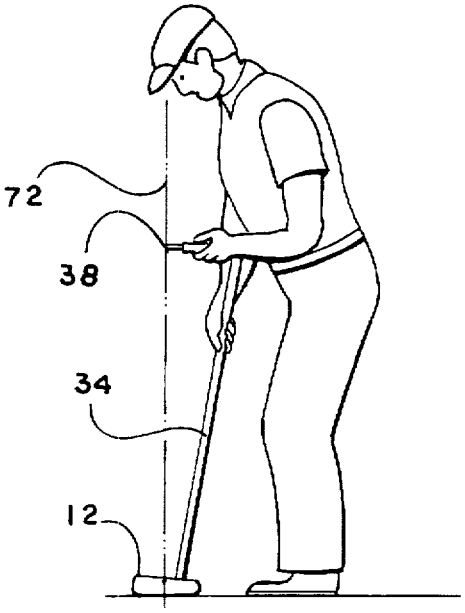

FIG. 6 and FIG. 7 illustrate how to use the pendulum putter. Several different methods of use will be apparent to those skilled in the art. As illustrated in FIG. 6, while positioning the putter, the user grips the first handle 26 and holds the handle in a horizontal position, with the putter head adjacent to the golf ball 70 to be putted. The butt end 30 of the second handle may be rested against the abdomen, belt, or belt buckle, to secure the handle steadily against the body. Once the putter is positioned against the body, because of the angles of attachment of the main shaft to the club head and to the bearing head, the club head is extended away from the body, ready for play, with the ball 70 a slight distance away from the golfer's feet at a comfortable distance. This structure obviates the golfer having to stand directly over the ball.

As shown in FIG. 7, the golfer aligns the linear sight 38 by sighting along the line 72 down to the sight and thence to the golf ball 70. Next, the golfer glances along the length of the sight 38 toward the desired path, and aligns himself or herself so that the sight points toward the desired path. The golfer then grips the main putter handle grip 32 to rotate and lift the main putter shaft 34 relative to the axis of the bearing head, so as to effect a back swing of the club head. The golfer preferably maintains a grip with his or her hand on the handle grip 32 of the main putter shaft and guides or pushes the shaft into contact with the ball. By pushing the main putter shaft by continuing to grip the third handle, the golfer may increase control and add power to the putt.

Alternatively, the user may release the main putter handle grip 32, causing the shaft of the putter to swing down in a pendulum like arc and to contact the ball.

Yet another method of use is possible. Rather than resting the butt end 30 of the second handle against the body, it is possible for the golfer to support the weight of the putter by holding the first handle 26 in a horizontal position. In this manner, the user will be supporting the putter in a suspended position, allowing the main shaft to rotate. This method may be suitable for golfer's with a strong grip and forearm, but it is believed that many golfers will want to support some of the weight and keep a steadier posture by resting the butt end of the second handle against the body.

As described, the main putter shaft 34 is attached to the bearing head at a slight, but acute angle $a_1$. As shown in FIG. 6, with this construction, as the putter is positioned against the user's body, the club head is in a position to play the ball. While the user's upper hand is grasping the first handle 26, the forearm is in a neutral horizontal position supporting the putter for pendulum movement, and is not adjusting the putter in any way. Rather, the upper hand is merely holding the putter in place against the user's body and preventing the club head from turning horizontally.

This structure and method of use contrasts with a Scalise type putter, where the user has to adjust the club head by using the forearm to pull the horizontal handles upwards and twist the fixed handle. The present invention allows the user to concentrate on the backswing of the shaft with the free hand. The user can calculate the amount of force needed to make the putt corresponding to the distance of the ball away from the hole without worrying about the position of the upper hand. The pendulum putter allows the user to determine the amount of force necessary to effect putts of varying distance before having to concentrate on the position of the body during the putt.

It will also be appreciated that the positioning of the bearing head 20 and the second shaft or rod 24 in relation to the main putter shaft allows the main putter shaft to pivot at a point between the first handle and second handle, where the bearing head is located. Because the main putter shaft is pivoting between the first and second handles rather than pivoting at the body of the user as in the Vezina patent, the main shaft will move in a vertical plane. As a result of the synchronization between the pivot point and the club head, the resulting putt will be more accurate.

Finally, it will be understood that the preferred embodiment has been disclosed by way of example, and that other modifications may occur to those skilled in the art without departing from the scope and spirit of the appended claims.

What is claimed is:

1. A golf putter comprising:

a club head;

an elongate shaft having an upper end and a lower end, the lower end of said shaft affixed to and extending upwardly from said club head at a predetermined angle;

a first forward handle rotatably affixed to the upper end of said first shaft at a second predetermined angle and extending away from a user for gripping by the user;

a second handle rotatably affixed to the upper end of said first shaft and extending toward the user; and a third handle affixed to said shaft opposite the club head, whereby a user grips the first handle in order to support the putter, rests the second handle against the body, and employs the third handle to rotate the shaft relative to the axis of the first handle so as to swing the club head in a pendulum motion.

2. A golf putter according to claim 1, further comprising a bearing head affixed on the end of said shaft opposite said club head and having a bore with an axis extending substantially parallel to the club head.

3. A golf putter according to claim 2, wherein the shaft is a first shaft, and further comprising an elongate substantially horizontal second shaft rotatably mounted in and extending through the bore of said bearing head, to which said first handle and said second handle are affixed.

4. A golf putter according to claim 3, wherein said first handle comprises an aluminum cylinder press fitted onto said second shaft and an outer grip affixed to said aluminum cylinder.

5. A golf putter according to claim 3, wherein said second handle comprises an aluminum cylinder press fitted onto said second shaft and an outer grip affixed to said aluminum cylinder.

6. A golf putter according to claim 1, wherein said first handle is relatively longer than said second handle.

7. A golf putter according to claim 1, wherein said club head is bilaterally symmetrical.

8. A golf putter comprising:

a club head having a striking face between a heel portion and a toe portion;

an elongate first shaft extending upwardly from said club head;

a bearing head affixed on an end of said first shaft opposite said club head and having a bore with an axis extending substantially parallel to a plane containing the striking face of said club head;

an elongate substantially horizontal second shaft rotatably mounted in and extending through the bore of said bearing head;

a first forward handle affixed to one end of said second shaft and extending away from the heel portion of said club head and from a user for gripping by the user;

a second handle affixed to the other end of said second shaft and extending rearwardly toward the user; and a third handle affixed to said first shaft opposite said club head;

whereby a user grips the first handle in order to support the putter, rests the second handle against the body, and employs the third handle to rotate the first shaft relative to the axis of the bearing head so as to swing the club head in a pendulum motion.

9. A golf putter according to claim 8, wherein said first shaft is affixed to said bearing head at an acute angle.

10. A golf putter according to claim 8, wherein said first handle comprises an aluminum cylinder press fitted onto said second shaft and an outer grip affixed to said aluminum cylinder.

11. A golf putter according to claim 8, wherein said second handle comprises an aluminum cylinder press fitted onto said second shaft and an outer grip affixed to said aluminum cylinder.

12. A golf putter according to claim 8, wherein said first handle is relatively longer than said second handle.

13. A golf putter comprising:

a club head;

an elongate shaft extending upwardly from said club head;

a rotatable handle affixed to an end of said shaft opposite said club head; and an elongate linear alignment sight affixed to and extending perpendicularly from an end of said rotatable handle for allowing the user to align the club head in the desired direction of putting.

whereby a user swings the shaft relative to the rotatable handle to move the club head in a pendulum motion and sights along the alignment sight to align the putt.

14. A golf putter according to claim 13, wherein said shaft extends upwardly from said club head at a predetermined angle.

15. A golf putter according to claim 13, wherein said rotatable handle is affixed to said shaft at a predetermined angle such that the shaft extends downwardly from said rotatable handle and away from the user, allowing the user to sight the putt looking down over the alignment sight at the club head.

16. A golf putter comprising:

a club head having a striking face between a heel portion and a toe portion;

an elongate first shaft extending upwardly from said club head;

a bearing head affixed on an end of said first shaft opposite said club head and having a bore with an axis extending substantially parallel to a plane containing the striking face of said club head;

an elongate substantially horizontal second shaft rotatably mounted in and extending through the bore of said bearing head;

a rotatable first forward handle affixed to one end of said second shaft and extending away from the heel portion of said club head and away from a user for gripping by the user;

a second handle affixed to the other end of said second shaft and extending rearwardly toward the user; and an elongate linear alignment sight affixed to and extending perpendicularly from an end of said first handle for allowing the user to align the club head in the desired direction of putting, whereby a user grips the first handle in order to support the putter and align the sight, rests the second handle against the body, and swings the first shaft relative to the axis of the bearing head so as to move the club head in a pendulum motion.

17. A golf putter according to claim 16, wherein said first shaft extends upwardly from said club head at a predetermined angle.

18. A golf putter according to claim 16, wherein said bearing head is affixed to said first shaft at a predetermined angle such that the first shaft extends downwardly from said bearing head and away from the user.

* * * * *